US007481168B2

(12) United States Patent
Pike et al.

(10) Patent No.: US 7,481,168 B2
(45) Date of Patent: Jan. 27, 2009

(54) OFF-TRACK RAILROAD TRACK UNDERCUTTER APPARATUS

(76) Inventors: Lawrence Glenn Pike, 29482 91st Rd., Arkansas City, KS (US) 67005; Darin Glenn Pike, 10684 284th Rd., Arkansas City, KS (US) 67005; Cody Lee Holman, 6626 W. Adobe Rd., Ponca City, OK (US) 74601

( * ) Notice: Subject to any disclaimer, the term of this patent is extended or adjusted under 35 U.S.C. 154(b) by 315 days.

(21) Appl. No.: 11/100,775

(22) Filed: Apr. 7, 2005

(65) Prior Publication Data

US 2005/0155257 A1 Jul. 21, 2005

(51) Int. Cl.
*E01B 29/06* (2006.01)
*E02F 5/22* (2006.01)

(52) U.S. Cl. ..... 104/9; 37/104

(58) Field of Classification Search ..... 104/7.3, 104/5, 8, 9; 37/104; 171/16
See application file for complete search history.

(56) References Cited

U.S. PATENT DOCUMENTS

| | | | | |
|---|---|---|---|---|
| 1,747,196 A | | 2/1930 | Vodoz | |
| 2,899,759 A | | 8/1959 | Campbell | |
| 3,436,848 A | * | 4/1969 | Fekete et al. | 37/104 |
| 3,967,395 A | | 7/1976 | Stewart | |
| 4,563,826 A | | 1/1986 | Whitaker, Jr. | |
| 4,579,060 A | * | 4/1986 | Nameny et al. | 104/9 |
| 5,119,723 A | * | 6/1992 | Lovitt, Jr. | 104/7.1 |
| 5,271,166 A | * | 12/1993 | Theurer | 37/104 |
| 6,862,822 B1 | * | 3/2005 | Masse | 37/104 |

FOREIGN PATENT DOCUMENTS

| | | |
|---|---|---|
| JP | 4-277201 | 10/1992 |
| JP | 4-366202 | 12/1992 |
| WO | PCT/FI92/00300 | 5/1993 |

* cited by examiner

*Primary Examiner*—Robert J McCarry, Jr.
(74) *Attorney, Agent, or Firm*—Kenneth W. Iles

(57) ABSTRACT

An undercutter apparatus for scooping out contaminated gravel from beneath railroad tracks is designed for use off of the rail road tracks. It can be used when the grade of the ground adjacent to the railroad tracks is quite different from the grade of the railroad tracks. The apparatus includes a control head mounted on an excavator with the control head carrying hydraulically operated means for pivoting the undercutter bar 180° about a vertical axis; for pivoting the distal end of the undercutter bar up and down relative to the proximal end of the undercutter bar approximately 60° above or below in normal horizontal position; and for driving a continuous loop undercutter chain around the undercutter frame for dragging out the contaminated gravel. The undercover apparatus can be a locked into any selected position within these ranges of motion controlled by the control head, or additional positions controlled by operation of the excavator boom and used in that position.

14 Claims, 11 Drawing Sheets

OFF-TRACK RAILROAD TRACK UNDERCUTTER APPARATUS

CROSS-REFERENCE TO RELATED APPLICATIONS

Not Applicable.

STATEMENT REGARDING FEDERALLY SPONSORED RESEARCH OR DEVELOPMENT

Not applicable.

SEQUENCE LISTING

Not applicable

BACKGROUND OF THE INVENTION

The present invention is related to an apparatus for undercutting railroad tracks to remove contaminated gravel from the rail bed. More particularly, the apparatus operates from a location off of and adjacent to the railroad tracks, allowing trains to use the track while undercutting is performed.

DESCRIPTION OF THE RELATED ART INCLUDING INFORMATION DISCLOSED UNDER 37 C.F.R. 1.97 and 1.98

Railroad tracks consist of a pair of spaced parallel tracks held in place by closely spaced railroad ties lying under the tracks and perpendicular to them. The rails are typically fastened to the tracks by railroad spikes driven into wooden ties, or by brackets fastened to concrete ties. The ties are nestled into a gravel bed, which is laid directly onto graded soil.

In some circumstances, mud works its way upward into the gravel as railroad trains travel along the tracks. Introducing mud into the gravel bed alters the compression characteristics of the gravel bed when railroad trains travel on the rail road tracks, often permitting greater compression of the gravel along a portion of one rail that along the corresponding portion of the other rail, resulting in one rail being higher or lower than its companion rail. This difference in height becomes greater as more trains pass over the location, as the dipping in the lower section further compresses the gravel bed at that point, forcing more mud into the gravel and continually increasing the differences in height of the two rails. Eventually, a railroad train crossing an affected of track wobbles and, when the condition is severe enough, derails.

In some soil conditions, tracks are scarcely affected by this problem, but in other conditions, tracks must be conditioned by removing the contaminated gravel and replacing it with clean gravel every one or two years.

Further, when concrete ties are used, it is also important that mud be removed from under the tracks promptly because concrete ties that are damp for extended periods deteriorate very quickly and must be replaced. If they are continuously wet, they may last only a few months before disintegrating. Concrete ties tend to be used frequently in places where insect damage to wood is a serious problem, such as tropical or subtropical locations, where continuously wet ground is also common. Thus railroad tracks with concrete ties may require more frequent undercutting than railroad tracks with wooden ties.

While it would be possible to rebuild the entire track and underlying bed, this is too expensive and disruptive for routine track maintenance. It has been determined that the gravel bed underling the railroad tracks can be removed by inserting a long undercutter bar under the tracks and dragging the contaminated gravel from under the tracks and then replacing the contaminated gravel with clean gravel. The undercutter bar that has been developed for this task is like a large chainsaw, that is an elongated relatively narrow frame with a relatively thin horizontal cross section, with a closed loop moveable chain having projecting ripping knobs on its outer surface. When the chain is moved along the perimeter of the undercutter bar, the ripping knobs pull the contaminated gravel from under the railroad tracks. The contaminated material is typically pulled into a previously or simultaneously dug ditch that is parallel to and adjacent to one side of the tracks along the edge of the railroad bed. The ditch allows the undercutter bar to be positioned at the desired depth, allowing an entry point for the undercutter bar to be pushed sideways into the railroad track bed under the tracks. The ditch also provides a place for the excavated material to be deposited, with the material from the ditch and any excess material from under the tracks being wasted on site.

Clean gravel is dumped onto the tracks and is tamped into place with a separate machine, which resembles a large two-bladed spade that pushes down on the fresh gravel, forcing it into the spaces between the two tracks and disbursing it sideways under the ties to replace the gravel bed that was excavated. The tamping machine is not part of this disclosure.

The resulting new gravel bed must have the same compressive characteristics under each rail, or the train wobbling problem will reappear immediately. The best way to approach this goal is to provide a clean gravel bed that is uniformly thick throughout the width of the rail bed, which is made possible by removing the same depth of material throughout the width of the rail bed. In order to insure that contaminated gravel is removed to the same depth, conventionally a single undercutting pass is made, using an undercutter bar longer than the width of the rail bed. Further, however, the undercutter bar must be maintained parallel to the tops of the two tracks. Otherwise, the resulting clean gravel bed will have a different depth under each rail, creating immediately the wobbling train problem.

Many inventors have addressed theses problems and have patented inventions designed to address and solve them, including for example, U.S. Pat. No. 4,563,826, issued to Whitaker, Jr. on Jan. 14, 1986; U.S. Pat. No. 3,436,848, issued to Peppin et al. on Apr. 8, 1969; U.S. Pat. No. 2,899,759 issued to Campbell on Aug. 18, 1959; U.S. Pat. No. 1,747,196, issued to Vodoz on Feb. 18, 1930; PCT APP. WO 93/09292 disclosing an invention by Greus et al. and published on May 13, 1993; Japan 4-277201 and Japan 4-366202. All these prior art apparatus share one severely limiting characteristic-they all must ride on the rails.

Riding on the rails makes it easier to deploy and maintain the undercutter bar parallel to and underneath the railroad tracks because, once the depth of the cut is set, the undercutter bar may be kept in a single attitude, namely parallel to the plane of the wheels of the apparatus. This approach results in very serious inefficiencies because a railroad train cannot pass along the tracks while the undercutter apparatus is there.

An undercutter apparatus may work along a section of tracks for several hours or several days. Because typically only a few feet of a track are undercut before clean gravel is reinstalled, railroad trains can cross over the undercut section before the underlying gravel bed is replaced, although at very reduced speeds of about 20 kph (8-10 mph) but not while the undercutter apparatus is on the tracks. Three approaches to solving this problem have been employed in the past. The tracks may be entirely shut down for train use while the railroad bed is being reconditioned, but the considerable economic loss from having the tracks out of service is too severe for this to be a popular practice. A large and powerful crane may be placed on the site off the tracks and may be employed to remove the undercutter apparatus from the tracks, but this approach is not commonly used because it is frequently difficult to place such a crane alongside the tracks and to move it as the undercutter apparatus advances, and, again, the economic losses resulting from having such a crane idle most of the time are substantial, as are the costs of moving the undercutter apparatus on and off the tracks. Finally, and most commonly, the undercutter apparatus is driven along the tracks to a siding and is shunted off the main tracks to allow a railroad train to pass. Because sidings are expensive to build and maintain, however, their numbers have dropped dramatically over the years and the undercutter apparatus may have to move for three or four hours—they do not move quickly—to find a siding and once the railroad train has passed, the undercutter apparatus must be returned to the work site, resulting in a great loss of labor and idle capital. Therefore, none of these approaches is satisfactory, but until now, no better or more efficient means for undercutting railroad tracks has been invented.

Therefore, there is a need for a railroad undercutter apparatus that can be employed from a position off the tracks; that can maintain the undercutter bar parallel to the plane of the tops of the two railroad tracks despite changes in the topology of the ground adjacent to the rail bed; that can undercut tracks from either side of the rail bed; and that therefore allows railroad trains to pass over the tracks throughout the undercutting process.

BRIEF SUMMARY OF THE INVENTION

Accordingly, it is a primary object of the present invention to provide a railroad undercutter apparatus that can be employed from a position off the tracks.

It is another object of the present invention to provide a railroad undercutter apparatus that can maintain the undercutter bar parallel to the plane of the tops of the two railroad tracks despite changes in the topology of the ground adjacent to the rail bed.

It is another object of the present invention to provide a railroad undercutter apparatus that can undercut tracks from either side of the rail bed.

It is another object of the present invention to provide a railroad undercutter apparatus that therefore allows railroad trains to pass over the tracks throughout the undercutting process.

These and other objects of the present invention are accomplished by providing a hydraulicly operated control head connected to the distal end of the boom of an excavator, with an undercutter bar attached to the control head. The control head allows controlled movement of the undercutter bar by pivoting the distal end, or toe end, of the undercutter bar up and down by pivoting it about its proximal end, or heel end, and by pivoting it 180° about a normally vertical axis, allowing it to undercut railroad tracks from either side of the tracks and allowing it to be pivoted into a transport safety position pointing directly back toward the excavator. A separate hydraulic motor drives the undercutter chain.

Use of the excavator's capabilities allows the undercutter bar to be moved straight up and down and to be moved sideways, that is, the excavator can push the undercutter bar under the tracks. Articulation about all three axis of an xyz coordinate system allows the undercutter bar to be kept parallel to the plane of the tops of the tracks despite changes in the topology of the terrain adjacent to the tracks.

Other objects and advantages of the present invention will become apparent from the following description taken in connection with the accompanying drawings, wherein is set forth by way of illustration and example, a detailed specification of the present invention and the best mode currently known to the inventors for carrying out the invention.

DETAILED DESCRIPTION OF THE INVENTION

Figure 1:
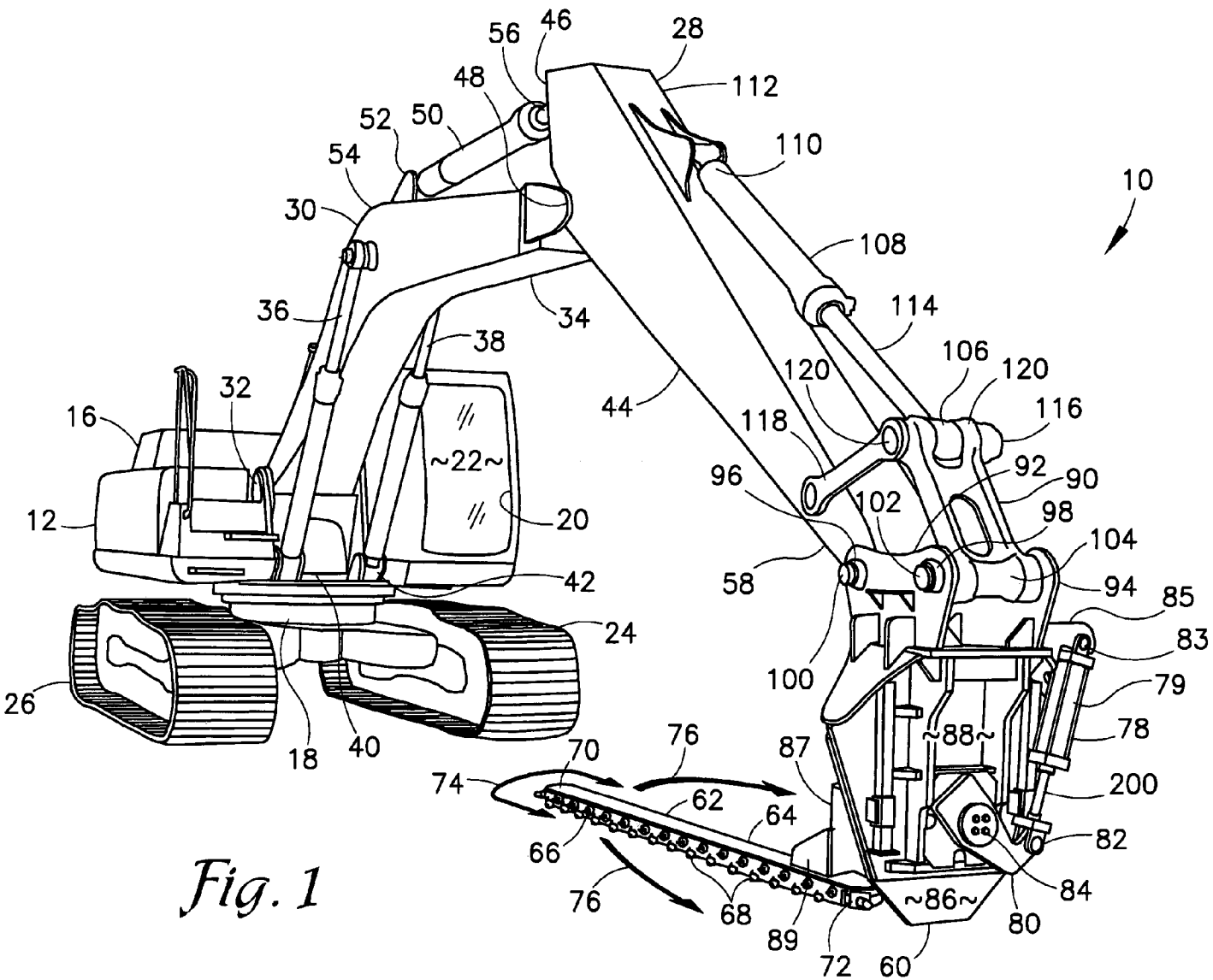
FIG. 1 is a right-hand front isometric view of an off-track railroad track undercutter apparatus according to the present invention.

Referring to FIG. 1, the off-track railroad track undercutter apparatus, or undercutter apparatus 10, includes a thirty-five ton (smaller is not powerful enough for the required work) excavator 12, which is a conventional excavator having a housing 16 mounted on a turntable 18 for rotation about a vertical axis. The housing 16, covers the engine, hydraulic and electrical systems and the like and includes an operator's cabin 20 having a transparent viewing window 22. The housing 16 is mounted on two spaced caterpillar track systems, which are a left-hand track 24 and a right-hand side track 26. A boom 28 projects outwardly from the front of the excavator housing 16 and includes a proximal articulating boom section 30, pivotally connected to the housing 16 by the bolt and yoke assembly 32 and having a distal end 34 that is moved up and down through an arcuate path by the two spaced double-acting hydraulic rams 36, 38, which are pivotally attached to the housing 16 by the yokes 40, 42, respectively.

Still referring to FIG. 1, a distal boom section 44 is pivotally connected adjacent to its proximal end 46 to the distal end 34 of the proximal boom section 30 by the yoke 48. The double-acting hydraulic ram 50 includes a proximal end 52 connected to the proximal boom section 30 approximately tangent to and at the bend 54 in the proximal boom section 30 and is connected at its distal end 56 to the distal boom section 44 adjacent to the proximal end 46 of the distal boom section. The ram 50 moves the distal end 58 of the distal boom section 44 up and down along an arcuate path. Both articulating sections of the boom 20 are conventionally made from box beams formed by welding different plates together. Conventionally, a bucket is attached to the far end of the boom 28, but in this case it is replaced with the undercutter control head 60.

Figure 3:
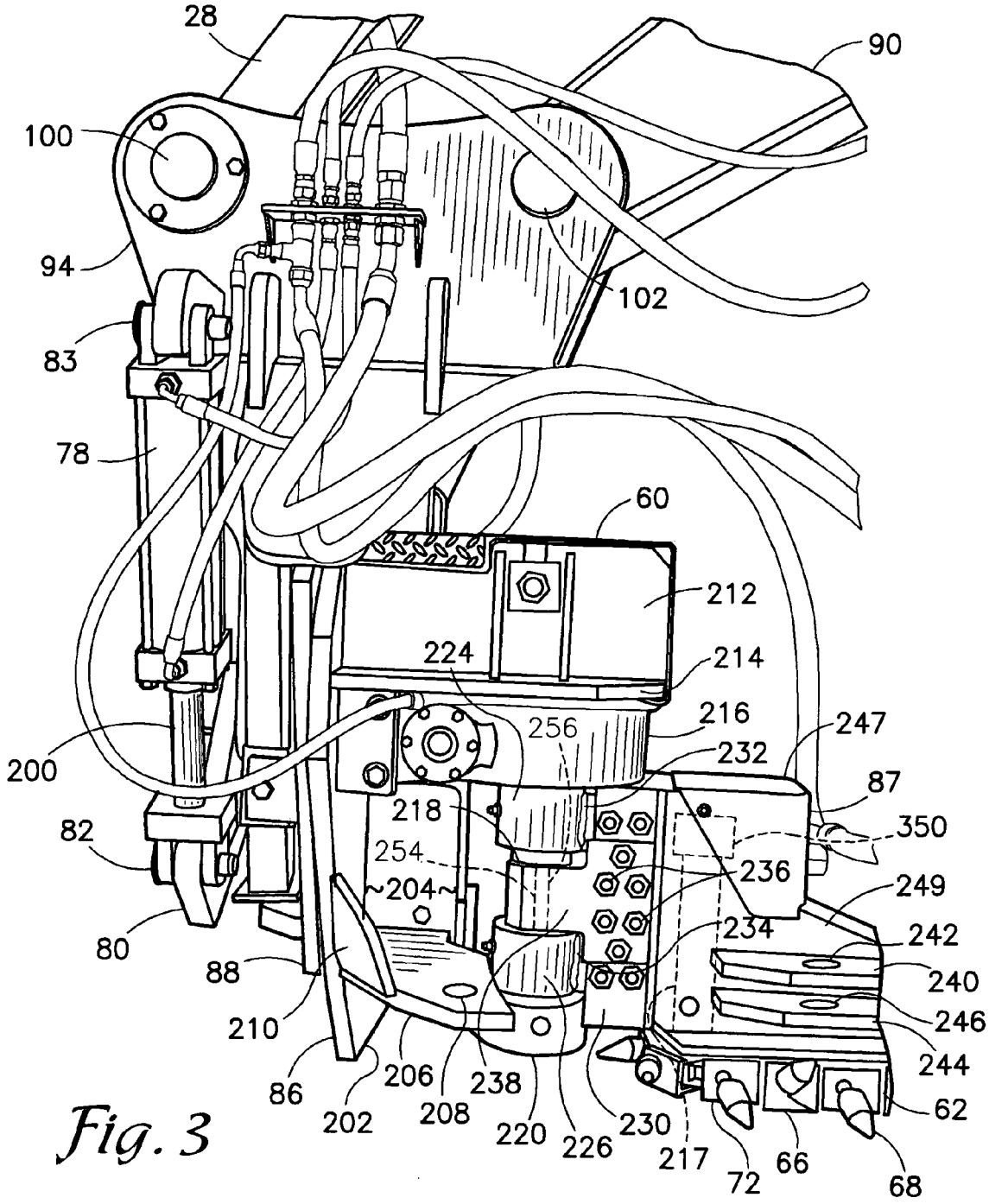
FIG. 3 is left-hand side view of the control head of the off-track railroad track undercutter of FIG. 1.

Still referring to FIG. 1, a first directional movement controlled by the undercutter control head 60 is movement of the undercutter chain 66 about a conventional undercutter bar 62 having an elongated frame 64 that carries a continuous loop undercutter chain 66 about its perimeter is connected to the undercutter control head 60. The undercutter chain 66 has a large number of ripping knobs 68 attached to and protruding from it. The undercutter bar 62 has a distal end, that is, the toe end 70 and a proximal end or heel end 72. The undercutter control head 60 includes systems for moving the undercutter chain 66 continuously about the perimeter of the undercutter bar 62 in the manner of a chain saw along the undercutter doubles-headed directional arrow 74 in either direction. In use, the undercutter chain 66 is rotated in one direction for undercutting and is reversed when it becomes stuck or ineffective, with travel in both directions driven by the hydraulic undercutter chain drive motor 350 (or reconfigured pump) (FIG. 10) in the motor housing 272 (FIG. 6) through the chain drive shaft 217 (FIG. 3).

Still referring to FIG. 1, a second directional movement produced and controlled by the undercutter control head 60 includes pivoting the undercutter bar 62 about a normally vertical axis through 180° of arc about the shaft 218 (FIG. 3)(regardless of the angle of the undercutter bar relative to a horizontal plane), with the position shown in FIG. 1 being the midpoint of that arc, that is, the undercutter bar 62 is moveable 90° to either side of the safety position that is, the neutral position, shown in FIG. 1, which is used for transporting the undercutter apparatus 10 since in this position the undercutter bar 62 does not project away from the excavator 12 or to either side of it. Thus the total range of motion of the pivoting movement of this operation, which takes place in a single plane if performed when no other pitch control is being used, is 180° (See FIG. 7). The pivoting movement is illustrated by the pivoting double-headed arrow 76. The undercutter bar 62 is pivoted about a normally vertical undercutter pivot drive shaft 218 (FIG. 3), which is driven by the pivot control hydraulic motor 278 (e.g., FIG. 8) operating through a gear and chain drive system shown in detail in FIG. 8 and discussed below.

Figure 11:
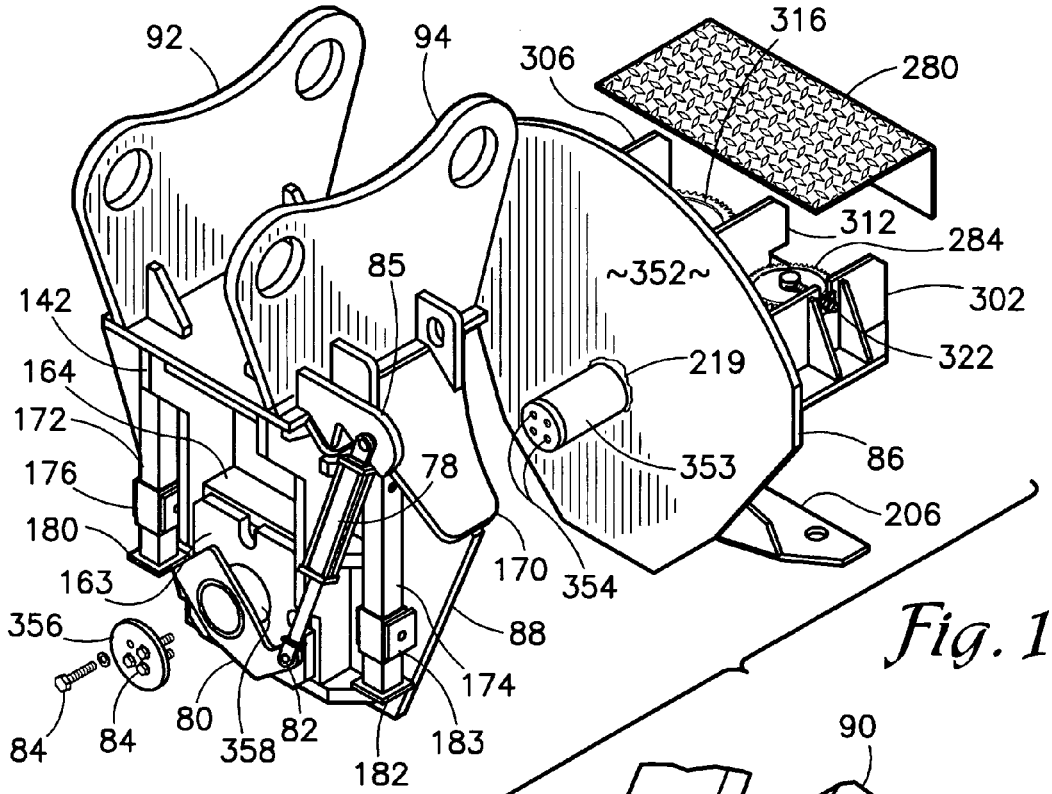
FIG. 11 is an exploded isometric view of the principal parts of the control head illustrating the connection between the front plate and the rear (pivoting) plate of the control head.

Still referring to FIG. 1, a third directional movement operated by and controlled at the control head 60 is a pitch control that allows the toe end 70 of the undercutter bar 62 to be raised or lowered relative to the heel end 72, that is, pivoted up or down about the heel end 72, by the pitch control double-acting hydraulic ram 78 attached at its lower end to the rotatable lever arm 80 by the pivoting fitting 82 and pivotally connected at its upper end to the pivot fitting 83 on a projecting ear 85 that is fixed to the rear plate 88 and projects to the left-hand side of the rear plate 88. The inner portion of the of the rotatable lever arm 80 is bolted by the bolts 84 into a pitch control shaft 353 (FIG. 11), which rotates a front plate 86 relative to the rear plate 88, which remains stationary relative to the tool fittings 90 of the excavator 12. The undercutter bar 62 and its drive motor 350 and associated chain drive shaft 217 (FIG. 4), found inside the undercutter motor housing 87, are mounted on the rotatable front plate 86, with the reinforcing gusset 89 fixed to the motor housing 87 and the undercutter bar 62. The front plate 86 and rear plate 88 of the control head 60, lie in parallel planes and are pressed together and held in their spatial relationship by the pivot shaft 253 (FIG. 11).

All three modes of motion of the control head 60 are independent of one another and can be undertaken simultaneously. Further, operating the excavator 12 conventionally allows the control head 60 to be moved up and down and from side to side. These operations too can be performed independently and simultaneously, leading to complete control of the undercutter bar 62 up and down, from side to side, back and forth relative to the operator's cabin 20 and the pitch of the undercutter bar 62 relative to a pivot point at its heel end 72, all simultaneously and while the undercutter chain 66 is being rotated about the undercutter bar 62. All motion of the undercutter bar 62 is preferably hydraulically controlled, as discussed particularly in FIG. 13.

Regarding definitions, throughout this paper, "front" is defined as the portion of the control head closer the operator while he is inside the cabin 20 and "rear" is defined as a part that is farther from the operator while he is inside the cabin 20. "Left" or "left-hand" and "right" or "right-hand and similar words or phrases are stated in reference to those orientations as viewed by an operator inside the operator's cabin 20. We further note that, for clarity, not all hydraulic hoses and fittings are shown in FIGS. 1-12, but all principal hydraulic hoses and connections are shown in FIG. 13.

Still referring to FIG. 1, the control head 60 is conventionally connected to the tool fittings 90 adjacent to the distal end 58 of the distal boom section 44. The right side yoke 92 has a parallel spaced mirror image left side yoke 94, with each yoke having a front aperture 96 and a rear aperture 98 that receive pins 100, 102 respectively that penetrate the front channel 104 and the rear channel 106 respectively in the tool fittings 90 at the distal end of the boom section 44 to hold the control head 60 onto the excavator 12.

Still referring to FIG. 1, a tool controlling double-acting hydraulic ram 108, which has a proximal end 110 pivotally connected to the distal end boom section 44 adjacent to the proximal end 112 of the distal end boom section 44. The distal end 114 of the ram 108 pushes or pulls on the channel 106, which is pivotally connected to the spaced parallel aligned left side arm 116 and right side arm 118, both of which pivot at each end, with the upper ends 120 being connected to the tool fitting 90 and the lower ends 120 being pivotally connected to the distal end boom section 44.

Figure 2:
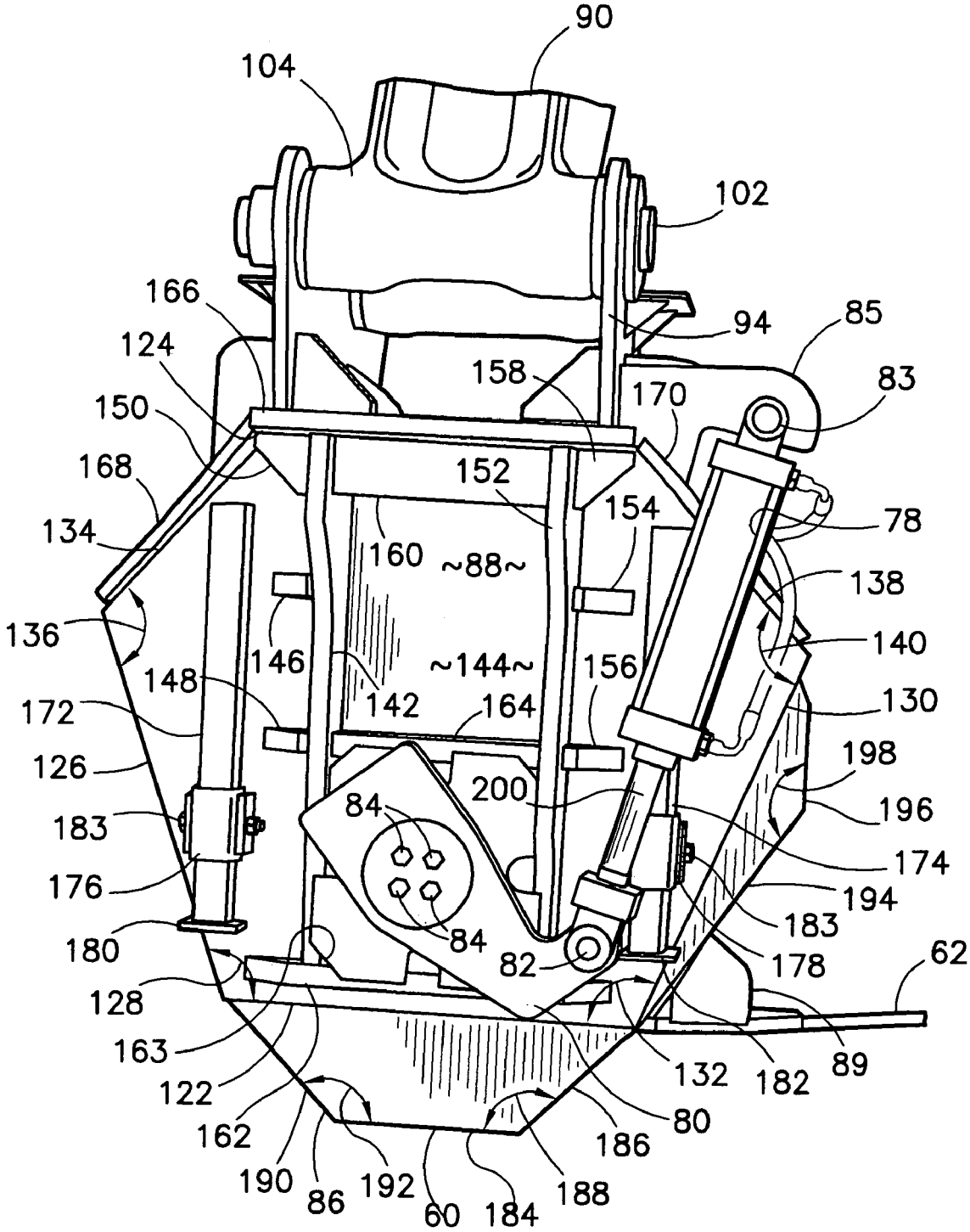
FIG. 2 is a rear view of the control head of the off-track railroad track undercutter of FIG. 1 shown attached to the excavator.

Referring to FIG. 2, the rear plate 88 of the control head 60 includes an irregular hexagonal perimeter having a normally horizontal bottom edge segment 184, and a spaced apart parallel straight top edge segment 124. A right-hand side edge 126 projects upwardly and outwardly from the right-hand end of the bottom edge 122 at the angle 128 of about 110° and a left-hand side edge 130 projects upwardly and outwardly from the left-hand end of the bottom edge 122 at an angle 132 of about 110°. A right-hand shoulder edge 134 connects the upper end of the right-hand side edge 126 to the right-hand end of the top edge 124, with an angle 136 of about 120° at the juncture of the right-hand shoulder edge 134 and the right-hand side edge 126. A left-hand shoulder edge 138 connects to a left-hand end of the top edge segment 140 at an angle of 120° as shown by the arrow 140.

Still referring to FIG. 2, a right-hand vertical reinforcing rib 142 is welded to the rear surface 144 of the rear plate 88, which is itself further reinforced by upper gusset plate 146, and lower gusset plate 148 and a top gusset plate 150. A left-hand vertical reinforcing rib 152 is spaced apart from and parallel to the right-hand vertical reinforcing rib 142 and is further reinforced by an upper gusset plate 154, a lower gusset plate 156 and a top gusset plate 158. An upper central horizontal gusset plate 160, which is spaced away from the rear surface 144 of the rear plate 88, connects the upper ends of the vertical reinforcing ribs 142, 152. A bottom central horizontal gusset plate 162 connects the lower ends of the reinforcing ribs 142, 152 and extends beyond them horizontally. An intermediate brace member 164 is fixed into a horizontal position between the reinforcing ribs 142, 152, between the top ends and bottom ends of the reinforcing ribs 142, 152. A perpendicular oriented top horizontal reinforcing plate 166 is welded to the rear surface 144 of the rear plate numeral 88. A perpendicularly oriented right-hand shoulder reinforcing plate 168 is welded to the right-hand shoulder 134. A perpendicularly oriented left-hand shoulder reinforcing plate 170 is welded to the rear surface 144 of the rear plate 88. The reinforcing members 166, 168, 170 project rearwardly of the plate 88.

Still referring to FIG. 2, a box is formed by the vertical reinforcing ribs and 142, 152, at the intermediate horizontal brace member 164 and the bottom horizontal reinforcing rib 162, which is essentially filled by the shaft reinforcing plate 163, which is welded to the rearward edges of the enclosing members.

Still referring to FIG. 2, a pair of vertically oriented square-tube jack stands, including a right-hand side jack stand 172 and a left-hand side jack stand 174, are mounted for vertical reciprocal motion in the jack stand sleeves 176, 178, respectively. Each jack stand 172, 174 includes a square foot 180, 182, respectively. The undercutter apparatus 10 is normally transported to and from a job site on a flatbed truck and when transported, the jack stands 172, 174 are lowered so that the feet 180, 182, contact the truck bed and support the undercutter control head 60, providing a more stable ride. If each jack stand is secured in the desired position by inserting a separate pin 183 through aligned apertures in each jack stand and its corresponding sleeve.

Figure 6:
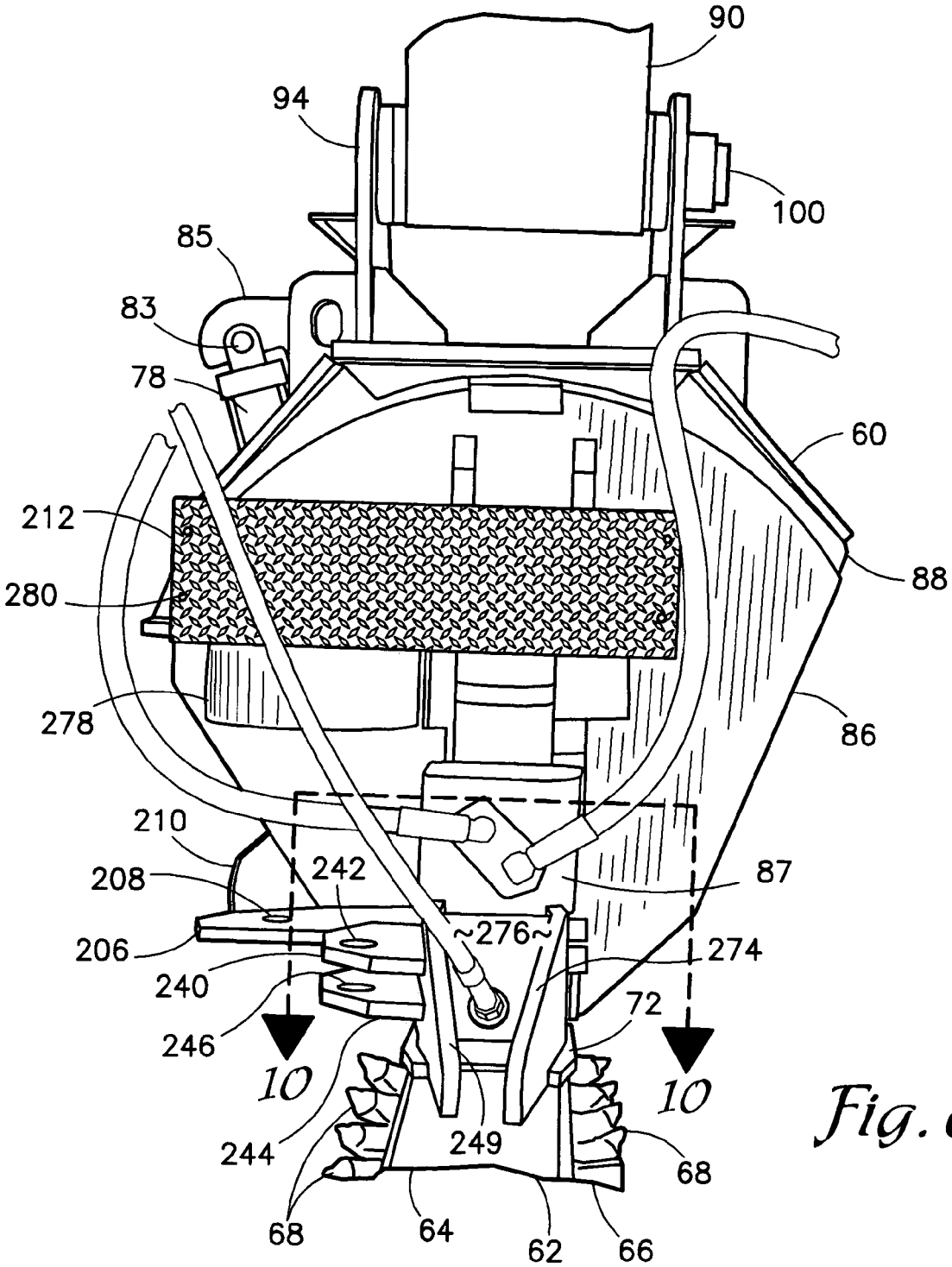
FIG. 6 is a front view of the control head and attached undercutter bar of the off-track railroad track undercutter of FIG. 1 showing the drive means for the undercutter chain.

Still referring to FIG. 2, the front plate 86 includes a straight normally horizontal bottom edge 184 that is below the straight bottom edge 184 of the rear plate 88 and parallel to it in the normal or neutral position, that is, when the undercutter bar 62 is horizontal. A lower left-side straight segment edge 186 projects upwardly an outwardly at an angle that indicated by the double headed arrow 188 of 130° and a corresponding right-hand edge segment 190 projects upwardly and outwardly at an angle indicated by the double headed arrow 192 of 130°. An intermediate left-hand side edge 194 projects further upwardly and outwardly on nearly a straight line from the segment 186, with the internal angle between them being approximately 170° and a vertical shoulder segment 196 projects vertically upward at an angle indicated by the double headed arrow 198 of 145°. An upper portion of the front plate 86 is essentially curved as shown in FIG. 6. As best shown in FIG. 6 (discussed below), the front plate 86 is symmetrical about its vertical centerline. The shapes of the front plate 86 and the rear plate numeral 88, which provide a top portion of the undercutter control head 60 or that is wider than the bottom portion of both the front plate 86 and the rear plate 88 of the undercutter control head 60, are designed to provide a substantially unobstructed view of the heel end 72 of the undercutter bar 62 to an operator inside the operator's cabin 20 of the excavator 12

Still referring to FIG. 2, the rear plate 88 remains stationary relative to the front channel 104 of the distal end of the boom section 44, that is, the tool fittings 90 on the distal end section 44 of the boom 28, while the front plate 86, which carries and supports the undercutter bar 62, rotates about the shaft (see, for example, FIG. 11) secured by the bolts 84 as the piston rod 200 of the double acting ram 78 is extended from or withdrawn into the cylinder 79. Because the undercutter bar 62 is fixed to the front plate 86, the toe end 70 of the undercutter bar rises or falls as the front plate 86 is rotated one direction or another relative to the rear plate 88. The rear plate 86 is fixed to the rear plate pivot shaft 353 by the weld bead 219 (FIG. 11).

Figure 4:
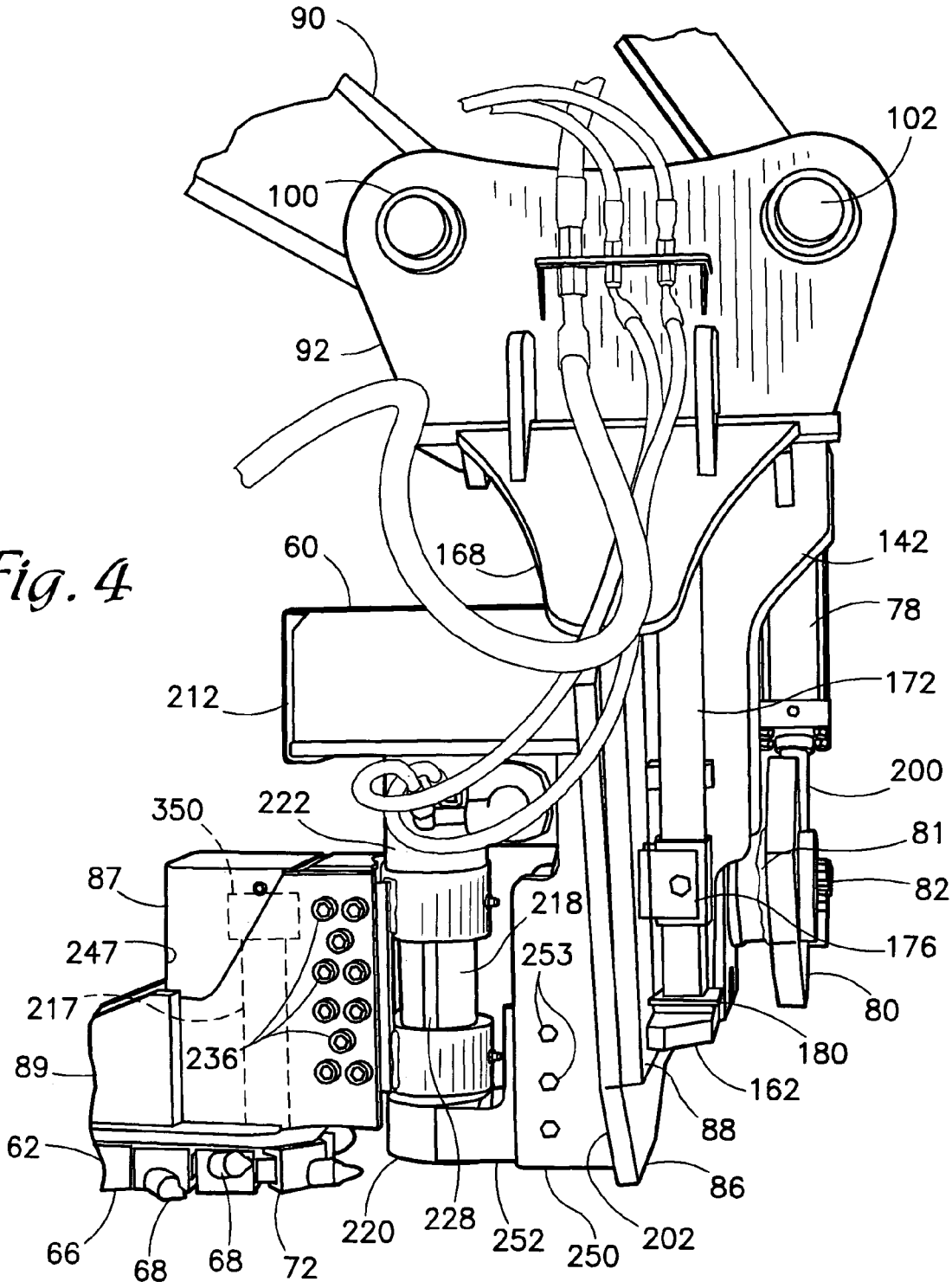
FIG. 4 is a right-hand side view of the control head of the off-track railroad track undercutter of FIG. 1.
Figure 5:
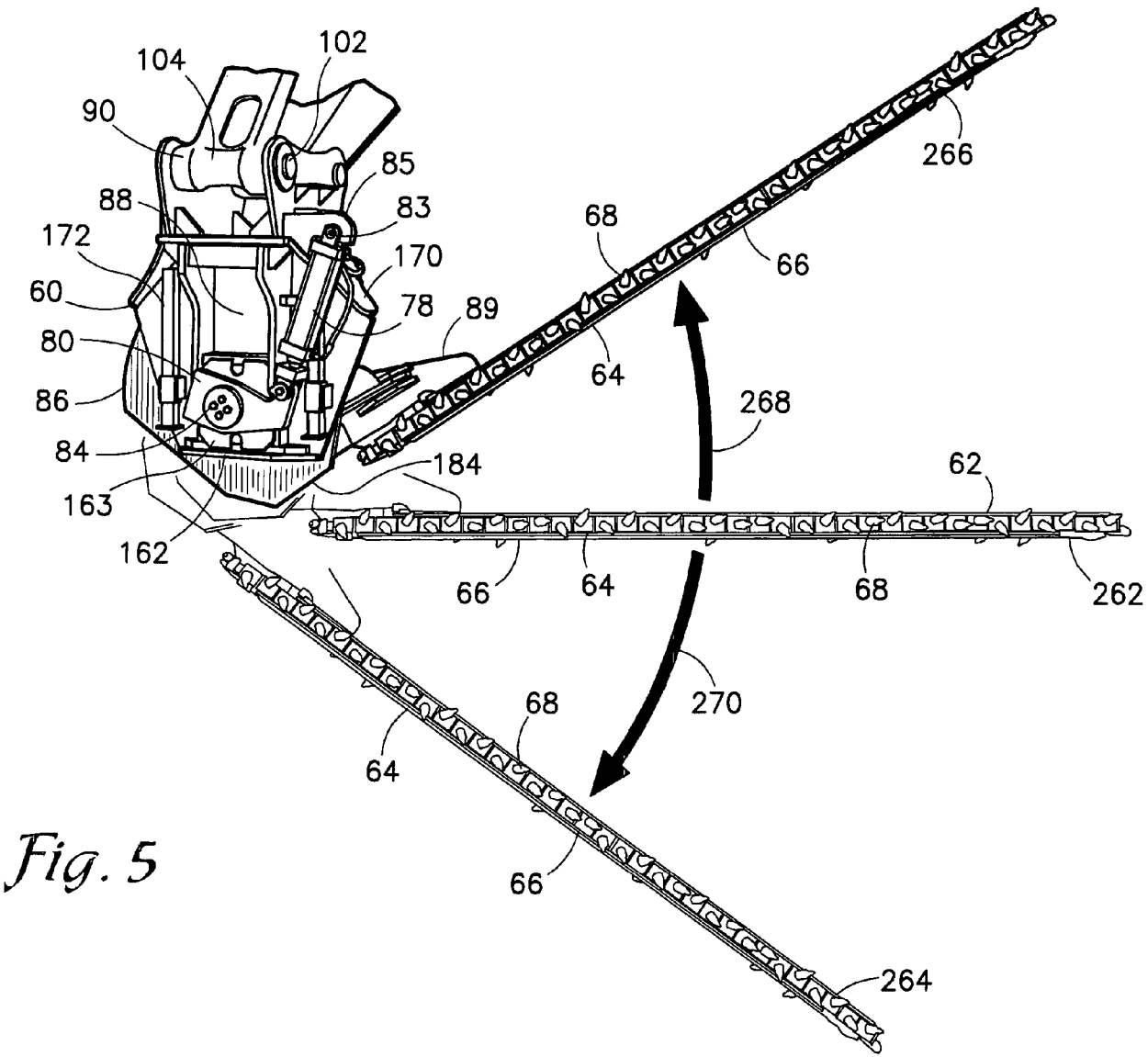
FIG. 5 is rear view of the control head of the off-track railroad track undercutter of FIG. 1 with the undercutter bar attached, illustrating the pivoting movement of the undercutter blade up and down at its distal end.
Figure 7:
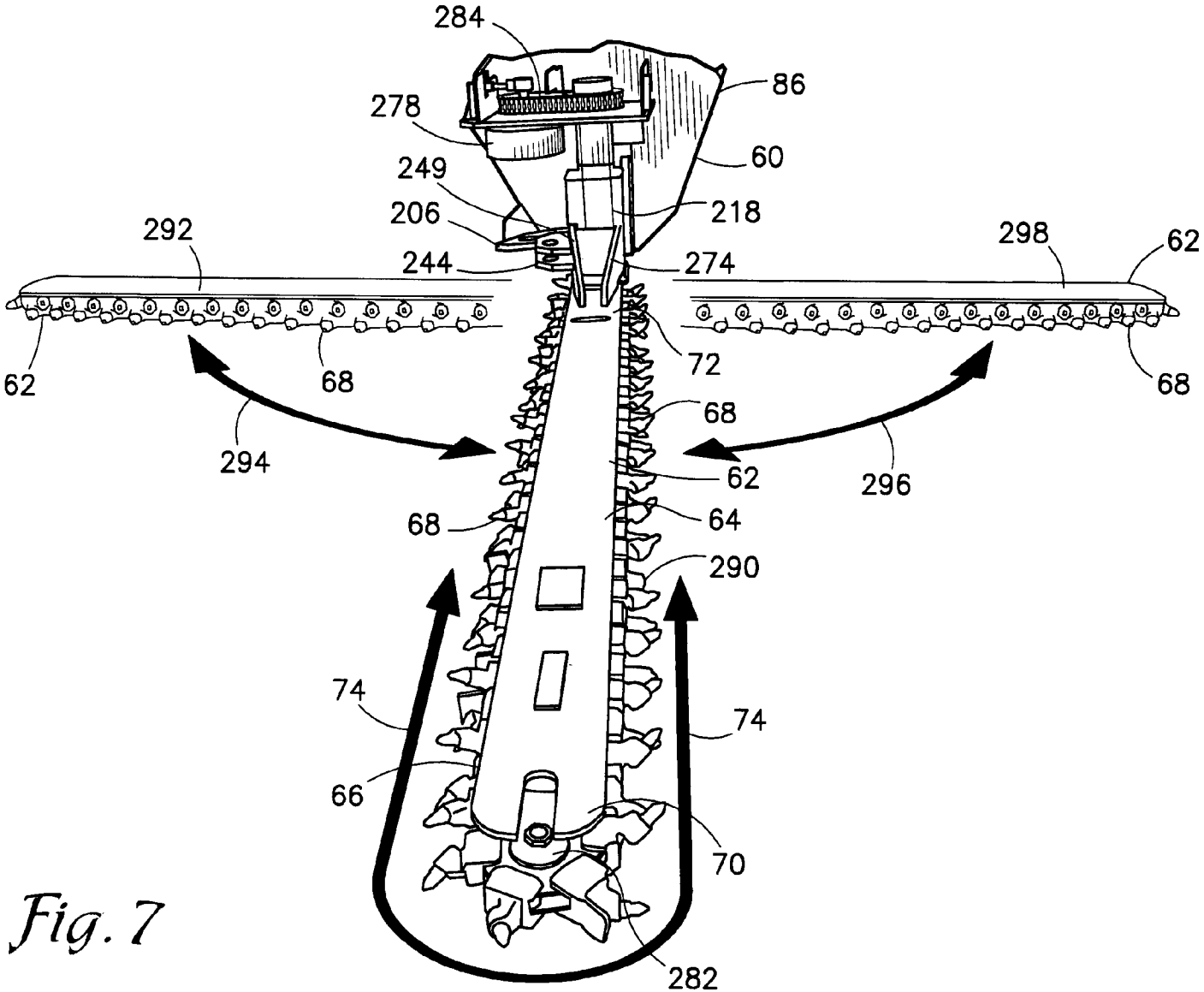
FIG. 7 is a front isometric view of the undercutter bar attached to the control head of the off-track railroad track undercutter of FIG. 1, with the distal end of the undercutter bar being closest to the view.
Figure 8:
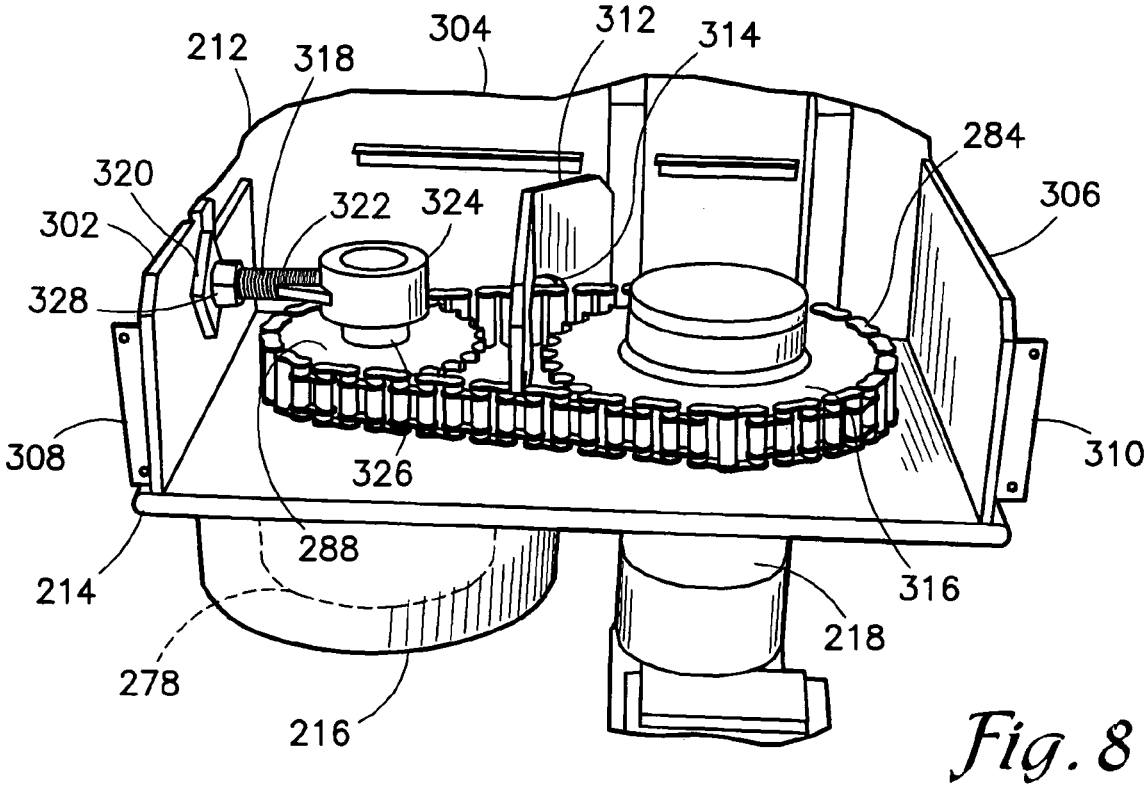
FIG. 8 cutaway isometric front view of the drive system of the control head of the off-track railroad track undercutter apparatus of FIG. 1 for pivoting the undercutter bar in its plane about a vertical axis.

Referring to FIG. 3, the undercutter bar 62 is pointing back toward the operator's cabin 20 of the excavator 12, that is, its safety position used for transporting the undercover apparatus 10 to a new job site. The undercutter bar 62 and its motion control components are fastened to the front surface 202 of the front plate 86, including the vertical support plate 204 and, fastened to its lower edge a horizontal combination reinforcing and locking plate 206 that includes the aperture 208, connected by the reinforcing gusset 210. A drive mechanism housing 212, which contains the two drive gears and drive chain that pivot the undercutter bar 62 about its vertical axis and which are shown in greater detail in FIG. 8, is fastened to the upper surface of a horizontal supporting plate 214. A hydraulic pivot motor housing 216 is fastened to the lower surface of the horizontal supporting plate 214 and is offset forward of the undercutter pivot drive shaft 218, which pivots the undercutter bar 62 horizontally as shown in FIGS. 5, 7, is seated in its lower end in the lower drive shaft housing 220 and at its upper end in the upper end drive shaft housing 222 (FIG. 4). An upper drive collar 224 and a spaced parallel lower drive collar 226 received the drive shaft 218 and are fixed relative to the drive shaft 218 by the keeper 254 inserted into the key way 256 (FIG. 3). The collars 224, 226 are fixed into the undercutter support bracket 238 by the weld beads 232, 234. The undercutter support bracket 230 is fastened to the undercutter drive motor housing by the bolts 236.

Still referring to FIG. 3, a pair of spaced parallel horizontal reinforcing gussets, including the upper gusset and locking plate 240, including the locking aperture 242 and the lower gusset and locking plate 244, including the aligned locking aperture 246, receive the locking plate 206 when the undercutter bar 62 is in its preferred operating position, that is, perpendicular to the excavator 12 boom 28 and pointing to the left-hand side of the operator in the operator's cabin 20, which is the preferred position for undercutting. The locking plates 240, 246 are welded to the gusset plate 249. A locking pin 248 (FIG. 9) inserted into the three all aligned apertures 208, 244, 246 effectively locks the undercutter bar 62 into this position, i.e., projecting perpendicularly to the left-hand side of the excavator 12, providing a stronger connection between the undercutter bar 62 and the front plate 86, as shown in greater detail in FIG. 9. This is the preferred position for undercutting, but the undercutter bar 62 can be used for undercutting railroad tracks when the undercutter bar 62 is moved to any angle within its range of motion. Other angles may be required in order to move the undercutter apparatus 10 around obstacles adjacent to the railroad tracks, e.g., a switching house. The undercutter motor housing 87 further includes a pivotal access hood 247.

Still referring to FIG. 3, a frangible key 254 is inserted into the key way 256 in an undercutter support bracket 238 extension arm, which wraps partially around the undercutter pivot drive shaft 218.

Referring to FIG. 4, a right-hand side vertical reinforcing plate 250 is fastened to the front surface 202 of the front plate 86, with the lower drive shaft housing 220 connected thereto by the bracket 252, which is fastened to the vertical reinforcing plate 250 by the bolts 253, and which wraps around to the left-hand side but is not visible in FIG. 3. A channel key way 228 is formed in the drive shaft 218 and an identical key way is formed across a diameter of the drive shaft 218.

Referring to FIG. 5, the undercutter bar 62 can be maintained in the horizontal position showed as the normal undercutter position 262 or any other position along a continuous arc from the lower position 264 to the upper position 266 as indicated by the up arrow 268 or the down arrow 270, that is through an arc of about 60° below the horizontal position and about 60° above the horizontal position, with the corresponding movement of the front plate 86 indicated by the phantom lines. This action is caused by the normally horizontal pivot shaft 353, which is rotated by the action of the double acting ram 78. When the piston rod is fully withdrawn into the double acting ram 78 the undercutter bar 62 is in the fully awkward position 266. When the piston rod is in its fully extended position, the undercutter bar 62 is in its fully downward position 264. Any position between the extreme up position 266 and the extreme lower position 264, can be achieved and maintained during undercutting, allowing the undercutter bar 62 to remain parallel to the railroad tracks despite dramatic differences between the grade of the railroad tracks in the grade of the adjacent ground that the undercutter apparatus 10 is working from. The relative rotation between the front plate 86, to which the undercutter bar and associated parts are fixed, relative to the stationary rear plate 88, is also shown clearly in FIG. 12.

Referring to FIG. 6, the housing 87 houses the hydraulic motor 350, which includes a drive shaft that has a gear on its distal end that directly engages the undercutter chain 66 to drive it around the frame 64 of the undercutter bar 62. The spaced mirror image gussets 249, which slant inward toward each other and which are welded to the undercutter frame 64 and have an insert brace 276 welded between them.

Still referring to FIG. 6, the pivot control hydraulic motor 278 is fastened to the lower surface of the chain drive mechanism 212 housing (also seen in FIGS. 8, 11), which moves the undercutter bar 62 though the 180° pivoting motion about a normally vertical axis as shown in FIGS. 1, 7). The front of the chain drive mechanism housing 212 includes a removable front access panel 280.

Referring to FIG. 7, the distal end or toe end 70 of the undercutter bar 62 includes a chain tensioning mechanism 282. The pivot control hydraulic motor 278 includes drive shaft with a gear fastened to it to drive the pivot drive chain 284, which in turn drives a larger gear that drives the pivot vertical pivot drive shaft 218, which can pivot the undercutter bar 62 from its storage or transport position 290, i.e., with the toe end 70 pointing to the center of the excavator 12, as shown in FIG. 7, to an extreme left-hand position 292 90° clockwise from the storage position as shown by the double headed arrow 294 or any position in between. Similarly, the undercutter bar 62 can be pivoted counterclockwise, as shown in FIG. 7, along the direction of the double headed arrow 296 to the extreme right-hand position 298 or any position in between.

Referring to FIG. 8, the chain drive mechanism housing a 212 includes a base 214 and fastened to it is a left-hand sidewall 302, a rear wall 304 and a right-hand sidewall 306, with a left-hand side flange 308 projecting outwardly from the front edge of the left-hand sidewall 302 and perpendicular to it and a corresponding right-hand side flange 310 extending outwardly from the front edge of the right-hand sidewall 306, for securing the removable front access panel 280, which forms the front sidewall and the top of the housing 212. An upstanding reinforcing internal wall 312 is fastened to the rear sidewall 304 along its rear edge and to the bottom plate 214 and includes a gate opening 314 through it to accommodate the passage of the pivot drive chain 284.

Still Referring to FIG. 8, the pivot control hydraulic motor number 278 drives the attached drive gear 288 and chain 284 to rotate the larger gear 316 thereby rotating the pivot drive shaft 218 in the same direction as the rotation of the shaft of the hydraulic motor 278, which is inside the hydraulic pivot motor housing 216.

Still referring to FIG. 8, a chain tension adjustment mechanism 318 includes a reinforcing plate 320 fastened to the interior surface of the left-hand sidewall 302 and includes a stud 322 pressing against a collar 324 fastened to the top of the hydraulic motor drive shaft 326 and received in the nut 328, which is secured to the reinforcing plate 320. The stud 322 penetrates an aperture in the left-hand side wall 302.

Figure 9:
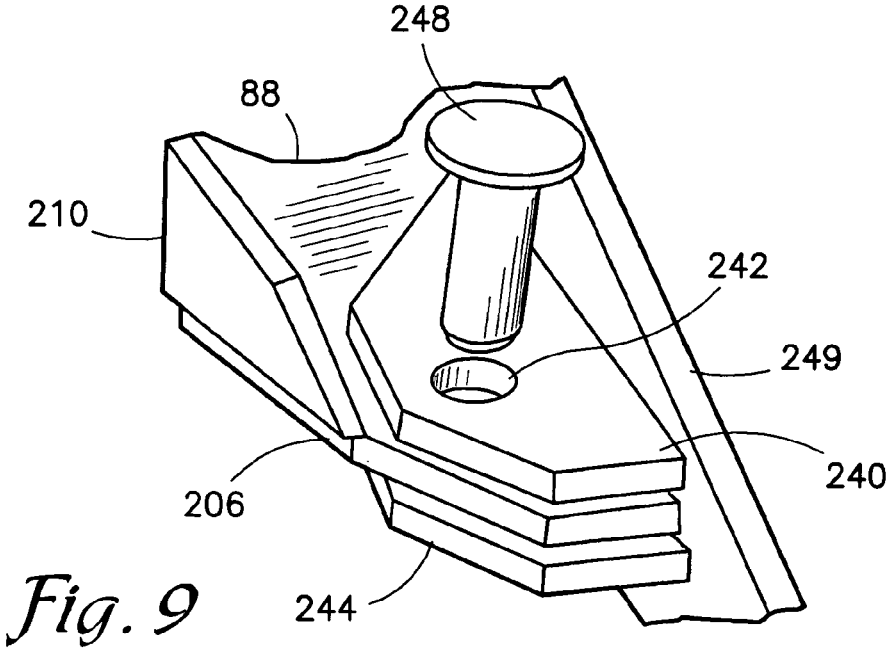
FIG. 9 is an enlarged fragmentary isometric view of a the lower left-hand portion of the left-hand side of the control head of the off-track railroad track undercutter apparatus of FIG. 1 showing the locking latch mechanism for locking the undercutter bar into its most frequently used position.

FIG. 9 is discussed above along with FIG. 3.

Figure 10:
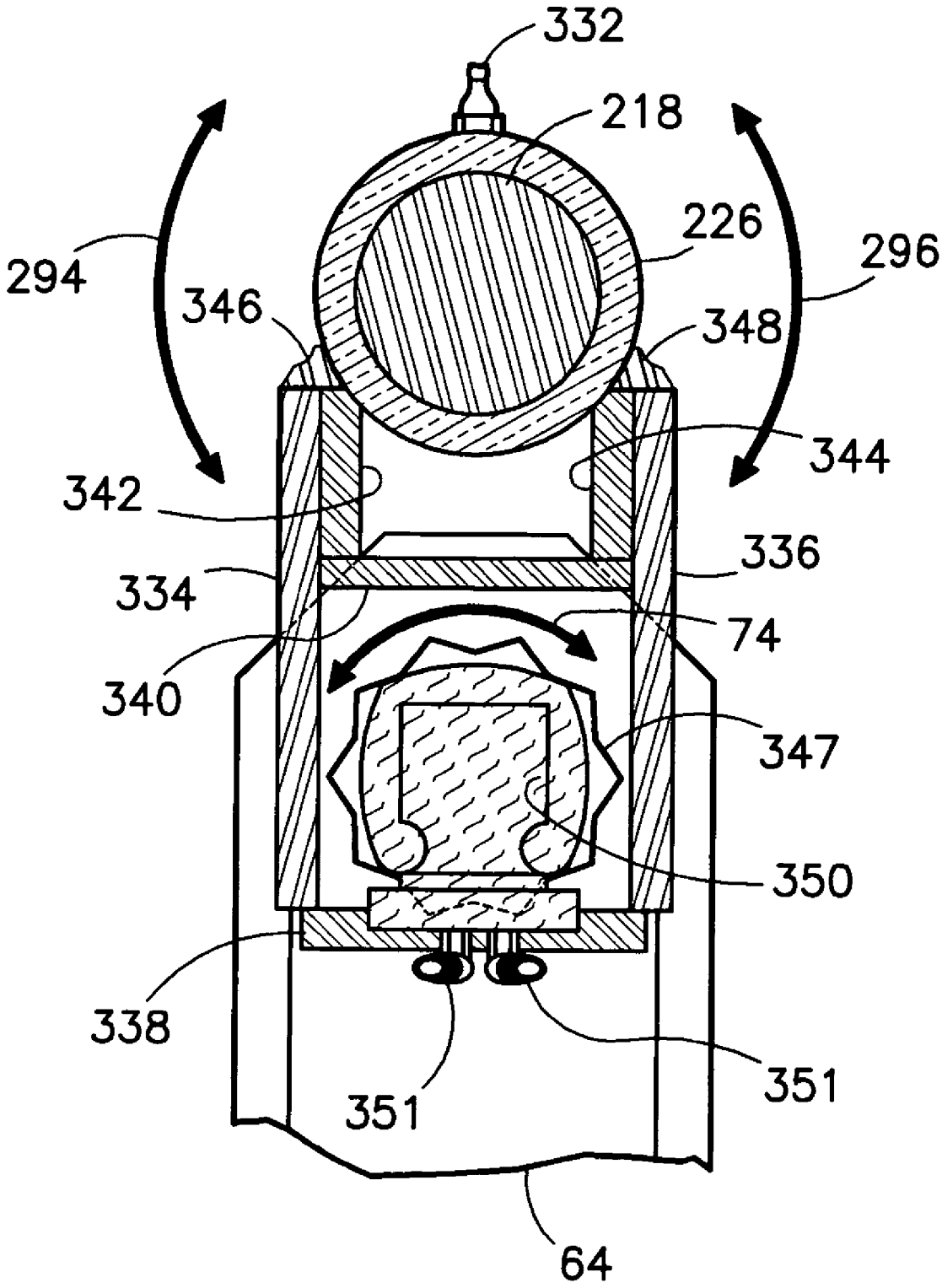
FIG. 10 is a simplified schematic cross sectional view taken along the lines 10-10 of FIG. 6 showing the pivoting axis for horizontal pivoting of the undercutter bar and the hydraulic motor for driving the continuous loop chain of the undercutter bar.

Referring to FIG. 10, the pivot drive shaft 218 is lubricated through the grease fitting 332. With a frame box housing includes a left-hand sidewall 334 and a parallel right-hand sidewall 336 and a perpendicular end wall 338. An intermediate reinforcing wall 340 lies between the left-hand sidewall 334 and the right-hand side wall 336 and abuts the left-hand internal reinforcing wall 342 and a corresponding right-hand internal reinforcing wall 344, both of which abut the lower drive shaft bushing 226 with the walls 334, 342 connected to the bushing housing (or lower drive collar) 226 by the weld beads 346, 348. Similarly, the walls 336, 344 are secured to the bushing housing 226 by the weld bead 348.

Still referring to FIG. 10, the space enclosed by the walls 334, 336, 338, and 340 provides a housing for the undercutter chain drive hydraulic motor 350, which is connected to the undercutter chain drive sprocket 347 and includes the hydraulic fittings 351 for connecting the undercutter chain drive hydraulic motor 305 to the hydraulic system shown in FIG. 13.

Referring to FIG. 11, the pivot shaft 353 is fixed to the rear surface 352 of the front plate 86 and includes four spaced threaded bores 354 for receiving the four corresponding fastening bolts 84, which are inserted through apertures in the pressure plate 356. The pressure plate 356 is designed primarily to keep the front plate 86 and the rear plate 88 together, i.e., to prevent the rear plate 88 from falling off of the control head 60. Suitable lubricant can be placed on the inner surfaces of the two plates. The pivot shaft 353 is received in the pivot drive shaft bushing 358.

Figure 12:
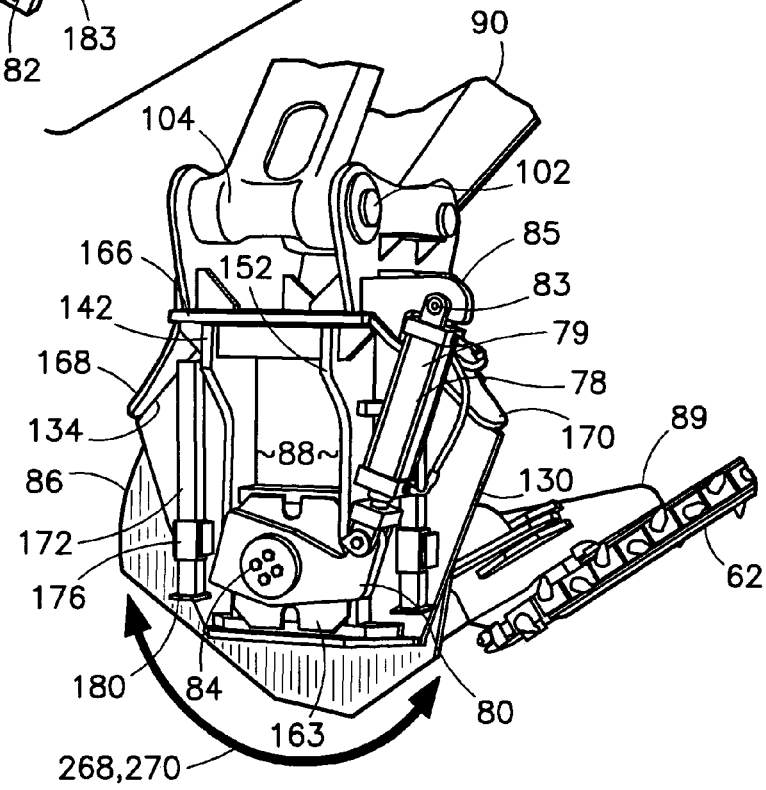
FIG. 12 is an isometric view of the control head of FIG. 5 accentuating the pivoting movement of the front plate to control the angle of the undercutter bar.
Figure 13:
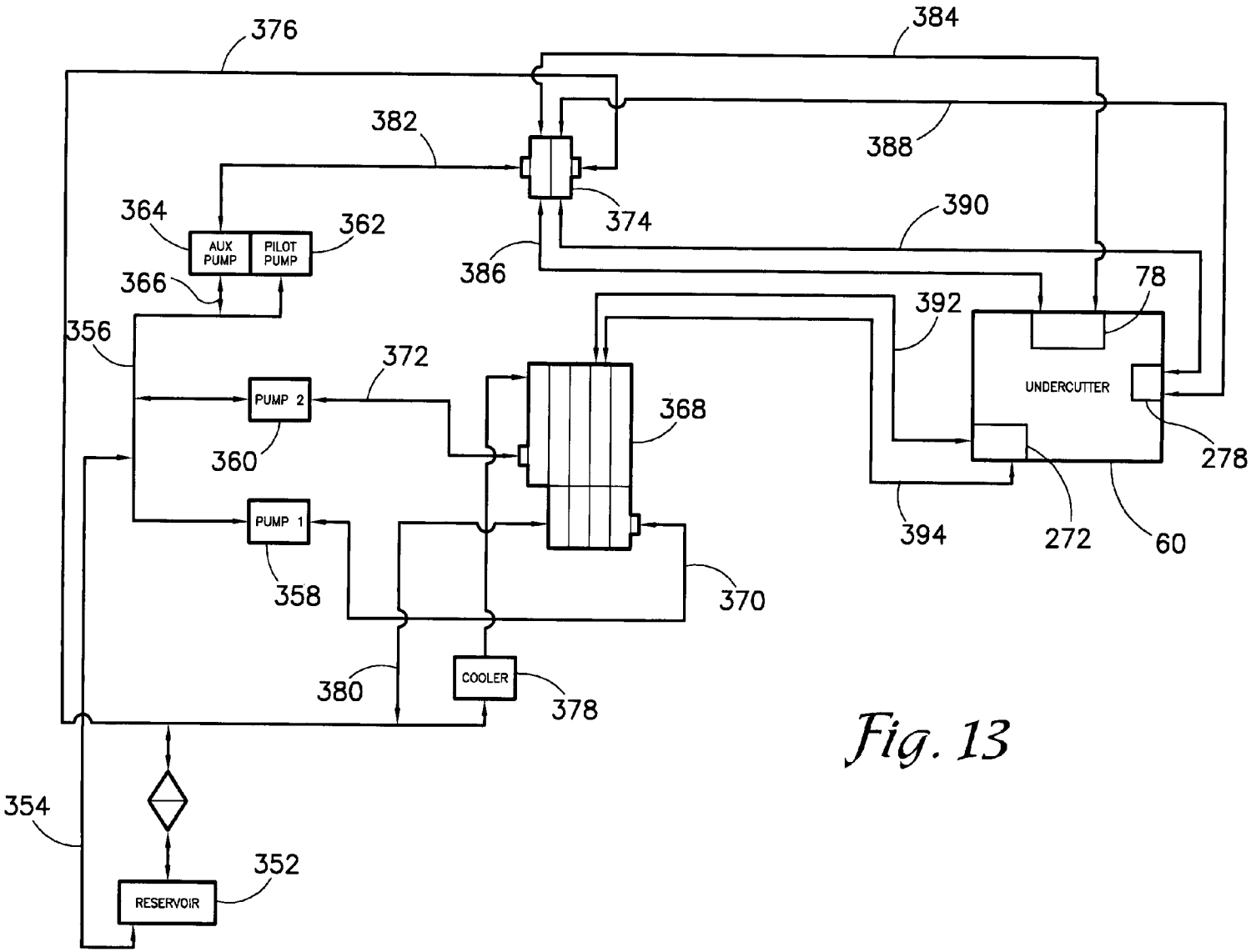
FIG. 13 is a schematic view of the hydraulic control system for controlling and operating the movements of parts on the control head of the off-track railroad track undercutter apparatus of FIG. 1.

FIG. 12 subject matter is discussed above in the discussion of FIG. 5.

Referring to FIG. 13, the movements performed by the undercutter control head 60 are controlled by hydraulic pressure operating hydraulic motors or rams, with the double acting ram 78 controlling the pitch, or tilt, movement, of the undercutter bar 62 (shown best in FIG. 5); the hydraulic undercutter chain drive motor 350 for driving the undercutter chain 66 around the undercutter frame 64 so that it can rip gravel from under the rail bed, as best shown in FIG. 7 by the double-headed directional arrows 74; and the pivot or swivel control hydraulic motor 278, best shown in FIG. 7 by the double-headed directional arrows 294, 296, all being operated by and controlled by the illustrated hydraulic equipment.

Still referring to FIG. 13, the hydraulic fluid reservoir 352 is connected to the hydraulic line 354, which is connected to the hydraulic fluid distribution line 356, which is connected to pump 1 358 and pump 2 360, the pilot pump 362 and, through the hydraulic line 366, to the auxiliary pump 364. Pump 1 358 is connected to the main control valve 368 through the hydraulic line and pump 2 360 is connected to the main control valve 368 through the hydraulic line 372. The auxiliary valve 374 is connected to the main control valve 368 by the hydraulic line 376, which includes the cooler 378 interposed between the main control valve 368 and the auxiliary valve 374. An equalizer hydraulic line 380 is connected to the main control valve 368 and the hydraulic line 376. Providing additional power for the auxiliary valve 374 is the hydraulic line 382 connecting the auxiliary valve 374 and the auxiliary pump 364. The pitch control double acting hydraulic ram 78 is connected to the auxiliary valve 374 by the two hydraulic lines 384, 386. The pivot control hydraulic motor 278 is connected to the auxiliary valve 374 by the hydraulic lines 388, 390. The hydraulic undercutter chain drive motor 350 is connected to the main control valve 368 by the hydraulic lines 392, 394. The hydraulic undercutter chain drive motor 350 may be a hydraulic motor or a hydraulic pump configured to operate as a motor. All hydraulic lines or conduits used to operate the undercutter control head 60 of the undercutter apparatus 10 are bi-directional, that is, hydraulic fluid flows through each line back and forth, e.g., from right to left or from left to right, up or down, etc., depending on the functional demands being made on the hydraulic system at any particular time. All rams, motors and the like are double-acting, i.e., they can be powered in either direction of operation. Other hydraulic circuits can accomplish the same operations of the undercutter control head 60.

The control head 60 of the undercutter apparatus 10 is preferably fabricated of steel, with most joints being welded. Parts are of appropriate thickness, for example, the front plate 86 and the rear plate 88 are preferably about 3.2 cm (1.25") thick and most joints are welded, while some are bolted, as shown.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

We claim:

1. An apparatus for undercutting railroad tracks from a position off the tracks comprising:

a. an excavator having an articulated boom attached thereto, said boom having a distal end having a control head pivotally attached thereto, an undercutter bar attached to a lower portion of said control head, said undercutter bar having a heel end and a toe end;

b. said control head further comprising means for pivoting said toe end up and down relative to said heel end of said undercutter bar; and c. said control head further comprising means for pivoting said undercutter bar about a normally vertical axis at said heel end of said undercutter bar.

2. An apparatus in accordance with claim 1 further comprising means for driving a continuous loop chain about a perimeter of said undercutter bar, said driving means further comprising an undercutter chain drive motor fixed in a motor housing mounted to a pivotal front plate of said control head.

3. An apparatus in accordance with claim 1 wherein said means for pivoting said undercutter bar about an axis at said heel end of said undercutter bar means farther comprises a hydraulic motor mounted on a front plate of a control. head and connected to said undercutter bar by a chain connected to said hydraulic motor and an undercutter pivot drive shaft connected to said undercutter bar.

4. An apparatus in accordance with claim 3 wherein said means for pivoting said undercutter bar about an axis at said heel end of said undercutter bar further comprises means for pivoting said undercutter bar continuously throughout a range of 180° of arc with a neutral central position wherein said toe end of said undercutter bar points toward an operator and said range of 180° of arc further comprises 90° of arc on to either side of said neutral position.

5. An apparatus in accordance with claim 4 further comprising means for locking said undercutter bar into a preferred operating position, said locking means further comprising a pin inserted into apertures tat become aligned when said undercutter bar is moved into a preferred position relative to said front plate.

6. An apparatus for undercutting railroad tracks from a position off the tracks comprising:

a. an excavator having an articulated boom attached thereto, said boom having a distal end having a control head pivotally attached thereto, an undercutter bar attached to a lower portion of said control head, said undercutter bar having a heel end and a toe end;

b. said control head further comprising pitch means for pivoting said toe end up and down relative to said heel end of said undercutter bar, said control head pitch means for up and down pivoting motion of said toe end of said undercutter bar further comprising a pivotal front plate parallel to and in contact with a stationary rear plate connected to said boom, with said pivotal front plate being pivoted relative to said rear plate by a pivot shaft fixedly connected at one end to said front plate and having another end passing through an aperture in said rear plate and fixed to a pitch control double acting hydraulic ram at said other end for continually throughout a range of motion of 60° upward from a normal horizontal position and throughout a range of motion of 60° downward from a normal horizontal position; and c. said control head further comprising means for pivoting said undercutter bar about an axis at said heel end of said undercutter bar.

7. An apparatus in accordance with claim 6 wherein said pitch pivoting means further comprises a lever arm with said lever arm connected to a normally horizontal pivot shaft fixed to a front plate that carries said undercutter bar and said pitch controlling double acting hydraulic ram is connected to said lever arm.

8. An apparatus in accordance with claim 7 wherein said pitch control double acting hydraulic ram is pivotally connected at an upper end to said rear plate of said control head of said apparatus and said pitch control double acting hydraulic ram is pivotally is connected at a lower end to said lever arm.

9. An apparatus in accordance with claim 8 wherein said front plate rotates relative to said rear plate when a piston rod of said pitch controlling double acting hydraulic ram is extended from or withdrawn into a cylinder of said hydraulic ram for moving said undercutter bar up or down from a horizontal position.

10. An apparatus for undercutting railroad tracks from a position off the tacks comprising:

a. an excavator having an articulated boom attached thereto, said boom having a distal end having a control head pivotally attached thereto by a yoke an undercutter bar attached to a front plate of said control head, said undercutter bar having a heel end and a toe end and being attached to said front plate of said control head at is heel end;

b. said control head further comprising means for pivoting said toe end up and down relative to said heel end of said undercutter bar, said up and down pivoting means further comprising a pivot control shaft fixed to said front plate and actuated by means of a pitch controlling double acting hydraulic ram mounted on a rear side of a rear plate of said control head;

c. means for driving a continuous loop chain about a perimeter of said undercutter bar, said chain drive means fixed to said front plate; and d. means for pivoting said undercutter bar about a normally vertical axis adjacent to said heel end of said undercutter bar, said pivoting means further comprising a hydraulic motor mounted on said front plate and drive means connecting said hydraulic motor to a pivot drive shaft connected to said undercutter bar.

11. An apparatus in accordance with claim 10 wherein said means for moving said heel end of said undercutter bar up and down further comprises a said front plate and said rear plate lie parallel to each other and in contact with each other and said rear plate is stationary relative to said yoke, while said front plate can be pivoted about an a common center of both said front plate and said rear plate.

12. An apparatus for undercutting railroad tracks from a position off the tracks comprising:

a. an excavator having an articulated boom attached thereto, said boom having a distal end having a control head pivotally attached thereto by a yoke, said control head further comprising a rear plate having said yoke attached to it and attached to said distal end of said boom, with said rear plate being stationary relative to said yoke and a front plate parallel to and in contact with said rear plate and free to pivot relative to said rear plate, and an undercutter bar having a heel end and a toe end attached to said front plate at the heel end of said undercutter bar;

b. said control head further comprising means for pivoting said toe end up and down relative to said heel end of said undercutter bar, said up and down pivoting means further comprising a pivot control shaft fixed to said front plate and actuated by means of a pitch controlling double acting hydraulic rain mounted on a rear side of a rear plate of said control head;

c. said control head further comprising means for driving a continuous loop chain about a perimeter of said undercutter bar, said chain driving means further comprising means fixed to said front plate of said control head;

d. means for pivoting said undercutter bar about a normally vertical axis adjacent to said heel end of said undercutter bar, said pivoting means further comprising a hydraulic motor mounted on said front plate and drive means connecting said hydraulic motor to a pivot drive shaft connected to said undercutter bar.

13. An apparatus in accordance with claim 12 further comprising means for moving said excavator boom up and down.

14. An apparatus in accordance with claim 12 further comprising means for moving said excavator boom from side to side.

* * * * *